US006386910B1

(12) United States Patent
Yu

(10) Patent No.: US 6,386,910 B1
(45) Date of Patent: May 14, 2002

(54) ELECTRICAL CONNECTOR

(75) Inventor: Wei-Ting Yu, Taipei Hsien (TW)

(73) Assignee: Advanced Connecteck Inc., Hsintien (TW)

( * ) Notice: Subject to any disclaimer, the term of this patent is extended or adjusted under 35 U.S.C. 154(b) by 0 days.

(21) Appl. No.: 09/641,194

(22) Filed: Aug. 17, 2000

(51) Int. Cl.[7] ..... H01R 13/73
(52) U.S. Cl. ..... 439/567
(58) Field of Search ..... 439/567, 571, 439/572, 607, 609

(56) References Cited

U.S. PATENT DOCUMENTS 5,709,556 A * 1/1998 Tan et al. ..... 439/567
5,797,769 A * 8/1998 Yang et al. ..... 439/571
5,865,645 A * 2/1999 Embo et al. ..... 439/567
6,077,115 A * 6/2000 Yang et al. ..... 439/567

* cited by examiner

*Primary Examiner*—Gary Paumen
(74) *Attorney, Agent, or Firm*—Merchant & Gould P.C.

(57) ABSTRACT

An electrical connector includes an insulator housing that has a base portion, a mating portion, and two retaining extensions. A plurality of terminals extend in the mating portion. Each retaining extension includes a lower part formed with a retaining slot, a top retaining wall defining a top end of the retaining slot, and a bottom opening. A pair of board locking members have inserting portions disposed in the retaining slots, and locking pegs projecting downwardly from the inserting portions through the bottom openings. The inserting portions abut against the top retaining walls when the locking pegs are pushed upwardly by an external force.

6 Claims, 5 Drawing Sheets

ELECTRICAL CONNECTOR

BACKGROUND OF THE INVENTION

1. Field of the Invention

This invention relates to an electrical connector, more particularly to an electrical connector having a pair of board locking members for securing itself to a printed circuit board.

2. Description of the Related Art

FIGS. 1 and 2 illustrate a conventional electrical connector. The electrical connector includes an insulator housing 1, a plurality of terminals 112, a conductive shield 13, and a pair of conductive board locking members 12 for securing the connector to a printed circuit board 2.

The insulator housing 1 includes a longitudinally extending base portion 16 with two opposite end portions, a hollow mating flange 11 disposed between the opposite end portions of the base portion 16 and projecting from a front face of the base portion 16 in a transverse direction relative to the base portion 16, and two opposite L-shaped retaining extensions 17 extending respectively from the two opposite end portions of the base portion 16 in a longitudinal direction relative to the base portion 16. Each L-shaped retaining extension 17 has an upper part 171 with a front face co-planar with the front face of the base portion 16, and a lower part 172 projecting from a bottom end of the upper part 171 in the transverse direction opposite to the mating flange 11. A mounting recess 113 is formed in a rear face of the upper part 171 that is opposite to the front face of the upper part 171. A notch 116 is formed in the lower part 172 of each retaining extension 17, and extends in the transverse direction. A mounting groove 114 is formed in a top end of the upper part 171 of each retaining extension 17. A central hole 115 is formed in the upper part 171 of each retaining extension 17. A plurality of terminal passageways 111 are formed in two opposite side walls of the mating flange 11 for receiving the terminals 112 therein. The terminals 112 have solder tails projecting through the terminal passageways 111 and out of the insulator housing 1 into a plurality of apertures 22 in the printed circuit board 2.

The conductive shield 13 is mounted on and is disposed around the mating flange 11, and has two opposite end portions wrapped around the top and bottom ends and the front face of the upper part 171 of each retaining extension 17, and two opposite holes registered with the central holes 115 in the upper parts 171 of the retaining extensions 17.

Each board locking member 12 includes a stem portion 121 mounted in the mounting recess 113 in the respective one of the upper parts 171 and having a hole 123 registered with the respective central hole 115, a mounting tongue 122 projecting from a top end of the stem portion 121 into the mounting groove 114 in the respective one of the upper parts 171, an inserting portion 125 projecting from a bottom end of the stem portion 121 in the transverse direction opposite to the mating flange 11 and aligned with the notch 116 of the respective lower part 172, and a locking peg 124 projecting downwardly from the inserting portion 125 through the notch 116 and a through-hole 21 of the printed circuit board 2. The board locking members 12 and the two opposite end portions of the conductive shield 13 are secured to the opposite ends of the base portion 16 via screw means passing through the central holes 115 in the upper parts 171 of the retaining extensions 17, the holes 123 in the stem portions 121 of the board locking members 12, and the holes in the conductive shield 13. Each locking peg 124 includes two spaced apart flexible locking legs with anchoring ends engaging the printed circuit board 2 so as to secure the electrical connector to the printed circuit board 2. The conductive shield 13 is electrically connected to a grounding contact (not shown) of the printed circuit board 2 via the mounting tongues 122 of the board locking members 12 for grounding purposes.

The aforesaid conventional electrical connector is disadvantageous in that during assembly of the electrical connector and the printed circuit board 2, the locking peg 124 of each board locking member 12 tends to be twisted by a counter force (acting in a direction of arrow B shown in FIG. 2) that results when the locking pegs 124 are pushed into the through-holes 21 in the printed circuit board 2 via application of an external force acting in a direction of arrow A shown in FIG. 2. Moreover, the stem portion 121 and the mounting tongue 122 of each board locking member 12 also tend to separate from the mounting recess 113 and the mounting groove 114 in the upper part 171 of the respective one of the retaining extensions 17 when the locking pegs 124 are pushed into the through-holes 21 in the printed circuit board 2.

SUMMARY OF THE INVENTION

Therefore, the object of the present invention is to provide an electrical connector that is capable of overcoming the aforementioned drawbacks.

According to the present invention, an electrical connector comprises an insulator housing having a longitudinally extending base portion with two opposite ends, a mating portion disposed between the opposite ends and projecting from the base portion in a transverse direction relative to the base portion, and two retaining extensions extending respectively from the opposite ends of the base portion, each of the retaining extensions including a laterally extending lower part that is formed with a retaining slot extending in a lateral direction relative to the base portion and that has a top retaining wall disposed above and defining a top end of the retaining slot, a bottom retaining wall disposed below and defining a bottom end of the retaining slot, and a bottom opening formed in the bottom retaining wall and communicated spatially with the retaining slot, the mating portion having a plurality of terminal passages formed therein; a pair of board locking members, each having a laterally extending inserting portion disposed in a respective one of the retaining slots, and a vertically extending locking peg that projects downwardly from the inserting portion through a respective one of the bottom openings, the inserting portions of the board locking members abutting respectively against the top retaining walls within the retaining slots when the locking pegs are pushed upwardly by an external force; and a plurality of terminals mounted fittingly and respectively in the terminal passages in the mating portion.

BRIEF DESCRIPTION OF THE DRAWINGS

In drawings which illustrate an embodiment of the invention.

DETAILED DESCRIPTION OF THE PREFERRED EMBODIMENT

Figure 3:
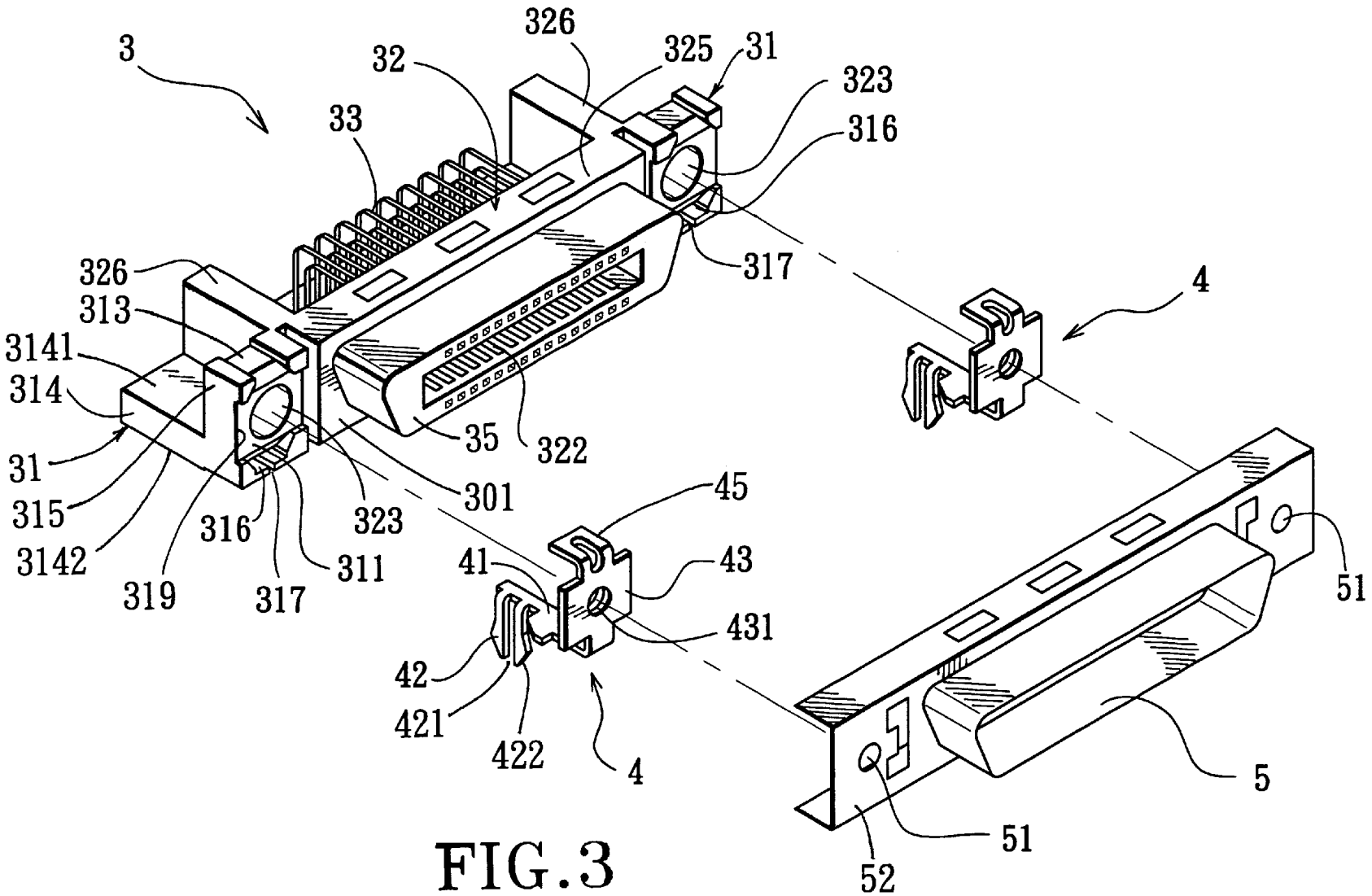
FIG. 3 is a partly exploded perspective view of an electrical connector embodying this invention.
Figure 4:
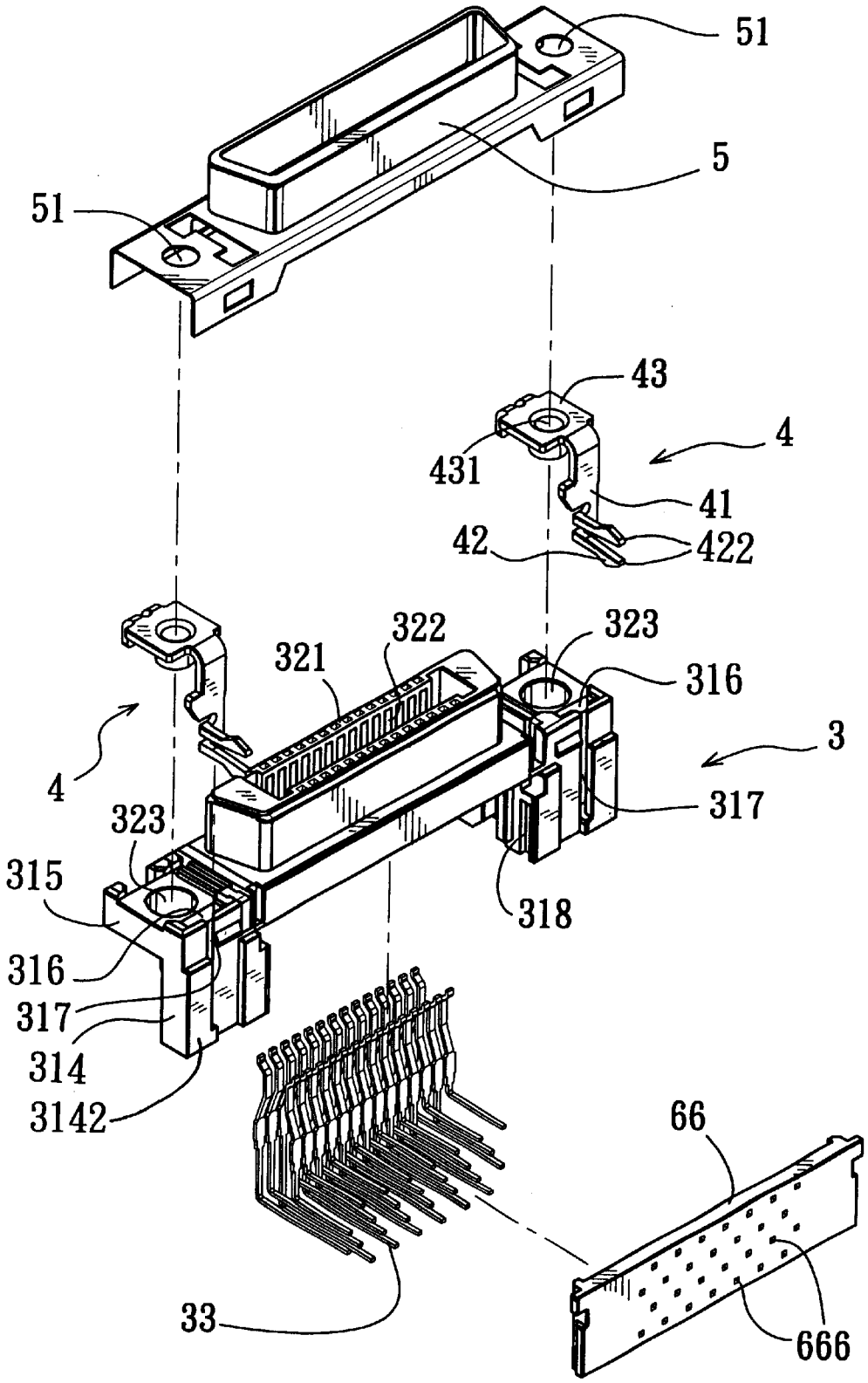
FIG. 4 is another exploded perspective view of the electrical connector of FIG. 3.
Figure 5:
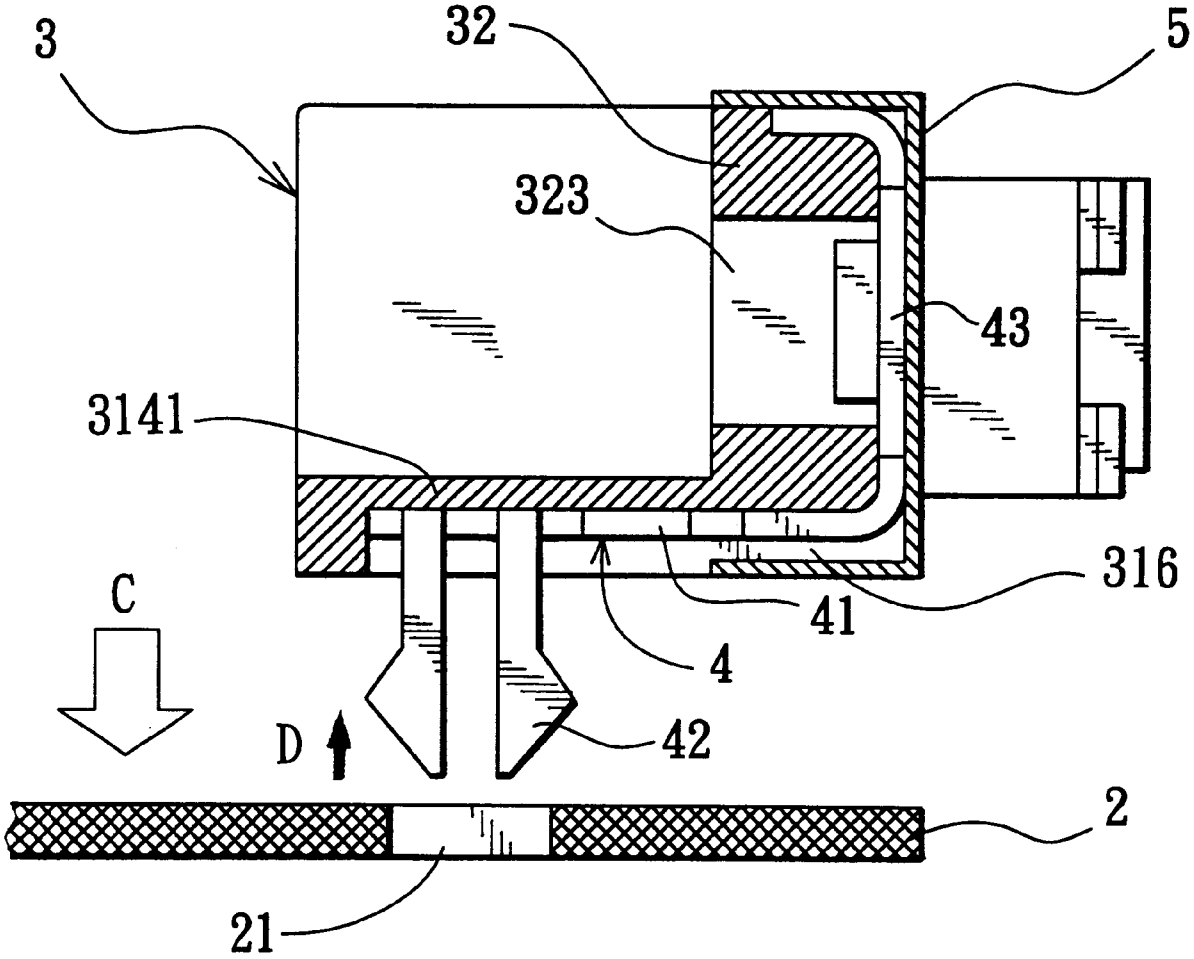
FIG. 5 is fragmentary cross-sectional side view to illustrate how the electrical connector of FIG. 3 is assembled onto the printed circuit board.

FIGS. 3 to 5 illustrate an electrical connector embodying this invention. The electrical connector is adapted to be mounted on a printed circuit board 2 (see FIG. 5), and includes an insulator housing 3, a plurality of terminals 33, a conductive shield 5, a positioning plate 66, and a pair of board locking members 4.

The insulator housing 3 includes a longitudinally extending base portion 325 with two opposite ends, a mating portion 35 disposed between the opposite ends of the base portion 325 and projecting from a front face 301 of the base portion 325 in a transverse direction relative to the base portion 325, and two L-shaped retaining extensions 31 extending respectively from the opposite ends of the base portion 325.

Each of the retaining extensions 31 includes a lower part 314 extending in the transverse direction opposite to the mating portion 35, and an upper part 315 extending upwardly from one end of the lower part 314. Each lower part 314 is formed with a retaining slot 316 extending in the transverse direction and having one end that is open at the end of the lower part 314, and has a top retaining wall 3141 disposed above and defining a top end of the retaining slot 316, a bottom retaining wall 3142 disposed below and defining a bottom end of the retaining slot 316, and a bottom opening 317 formed in the bottom retaining wall 3142, extending in the transverse direction from the end of the lower part 314, and communicated spatially with the retaining slot 316. Each upper part 315 has top and bottom ends, and a front face 311 which is co-planar with the front face 301 of the base portion 32 and which is formed with a mounting recess 319 between the top and bottom ends of the upper part 315. A mounting slot 313 is formed in the top end of each upper part 315, and opens at the front face 311 of the upper part 315. A central through-hole 323 is formed in each upper part 315 between the top and bottom ends of the upper part 315.

Two supporting extensions 326 project respectively from the opposite ends of the base portion 32 in the transverse direction opposite to the mating portion 35, and are connected respectively to inner sides of the retaining extensions 31. A pair of opposite sliding slots 318 are formed in inner faces of the supporting extensions 326. The positioning plate 66 has two opposite ends mounted slidably and respectively in the sliding slots 318.

A plurality of terminal passageways 322 are formed in two opposite side walls of the mating portion 35 for receiving the terminals 33 which extend through the passageways 322 and out of the insulator housing 3, and which has solder tails that are held and supported by passing through a plurality of apertures 666 in the positioning plate 66 and that are adapted to be soldered on the printed circuit board 2.

Each board locking member 4 is formed integrally as a stamped and bent metal plate, and has a laterally extending inserting portion 41 disposed in a respective one of the retaining slots 316, a vertically extending stem portion 43 that extends upwardly from one end of the inserting portion 41 and that is mounted in the respective mounting recess 319 so as to be flush with the front face 301 of the base portion 32, a vertically extending locking peg 42 that projects downwardly from the inserting portion 41 through a respective one of the bottom openings 317 and that is movable in the transverse direction along the respective bottom opening 317, and a hooking tongue 45 projecting from the stem portion 43 into the respective mounting slot 313. The locking peg 42 of each board locking member 4 has a slit 421 and a pair of opposite locking legs 422 that are spaced apart by the slit 421 and that project downwardly from the inserting portion 41 through the bottom opening 317 in the respective one of the lower parts 31. Each of the locking legs 422 has an anchoring bottom end that passes through a through-hole 21 in the printed circuit board 2 (see FIG. 5) and that is engageable with a periphery of the through-hole 21. A through-hole 431 is formed in the stem portion 43 of each board locking member 4.

The conductive shield 5 is mounted on and is disposed around the mating portion 35, and has a base plate 52 with two opposite end portions that are respectively formed with through-holes 51 and that cooperate with the upper parts 315 of the retaining extensions 31 to sandwich the stem portions 43 of the board locking members 4, respectively. The board locking members 4 and the conductive shield 5 are secured to the base portion 32 of the insulator housing 3 via screw means passing through the central holes 323 in the upper parts 315, and the through-holes 431, 51 in the stem portions 43 and the base plate 52.

Figure 1:
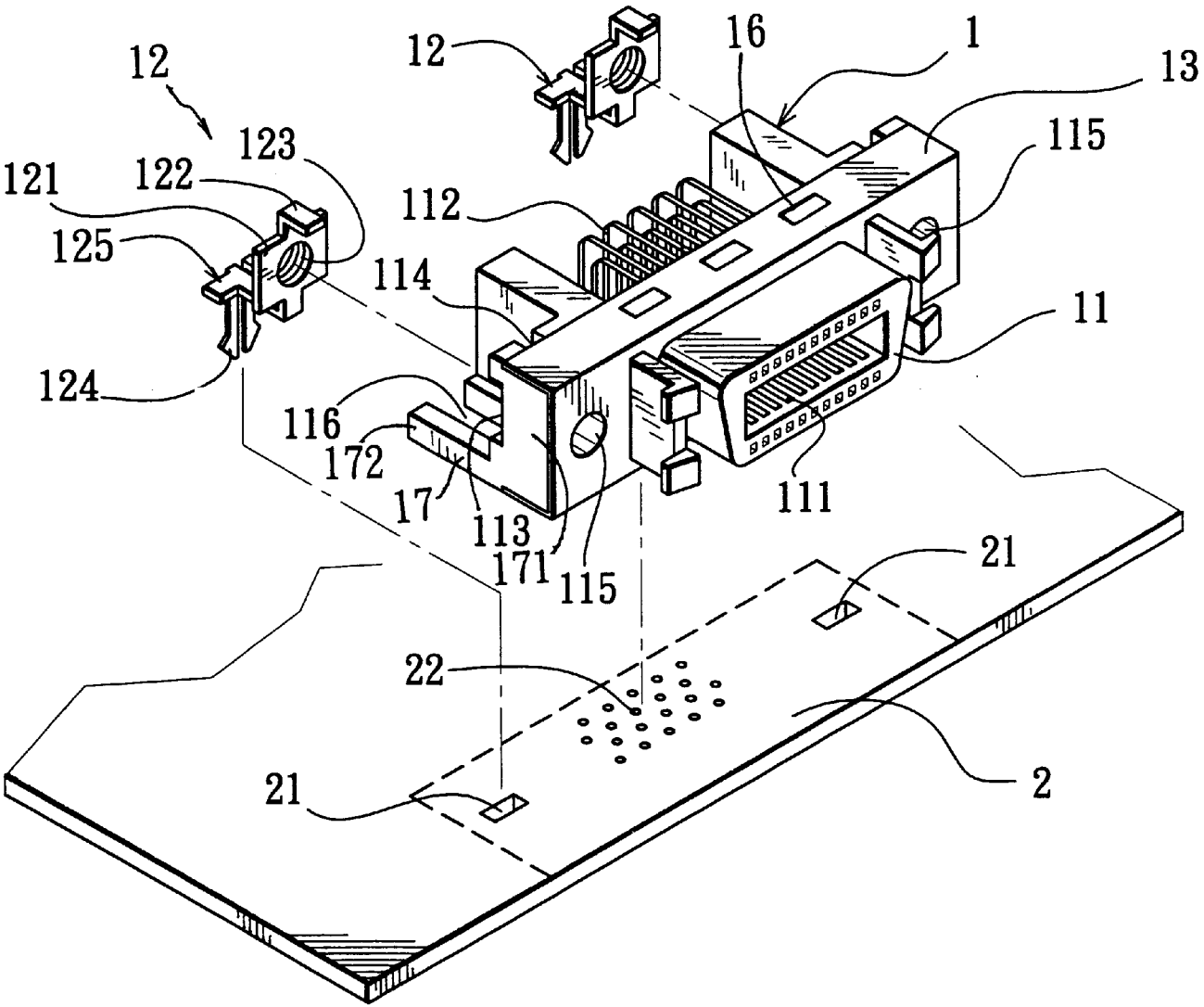
FIG. 1 PRIOR ART
FIG. 1 is a partly exploded perspective view of a conventional electrical connector adapted to be mounted on a printed circuit board.
Figure 2:
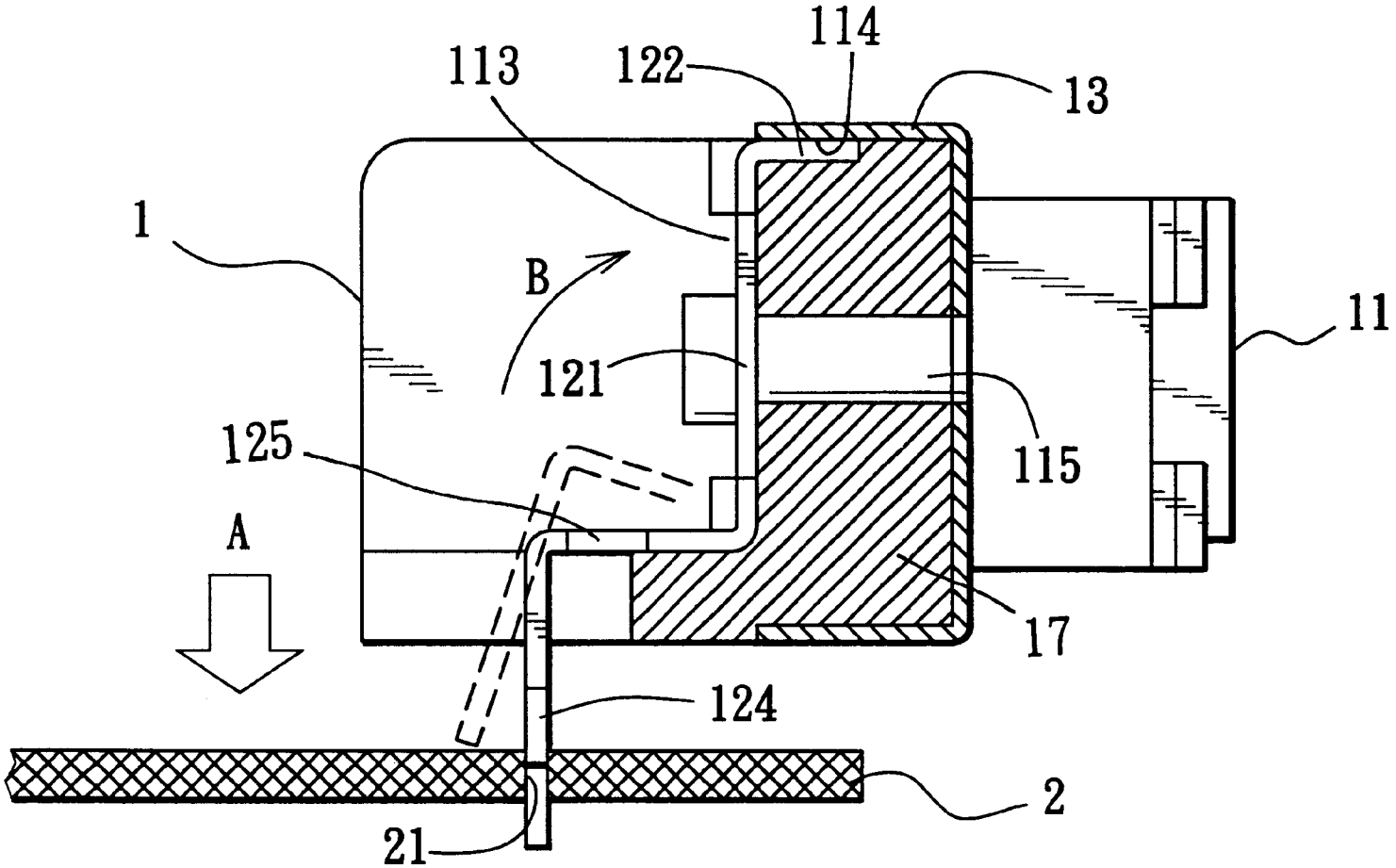
FIG. 2 PRIOR ART
FIG. 2 is a fragmentary cross-sectional side view to illustrate how the electrical connector of FIG. 1 is assembled onto the printed circuit board.

During assembly of the electrical connector and the printed circuit board 2, the top retaining walls 3141 of the lower parts 314 of the retaining extensions 31 will respectively abut against the inserting portions 41 of the board locking members 4 due to a reaction force (acting in a direction of arrow D shown in FIG. 5) that occurs when the locking pegs 42 are pushed into the through-holes 21 in the printed circuit board 2 by an external force acting in a direction of arrow C shown in FIG. 2, thereby preventing the inserting portions 41 from tilting upwardly at one end distal from the stem portion 43 and from being twisted and thereby preventing the stem portion 43 and the mounting tongue 45 from separating from the upper part 314 of the respective retaining extension 31 as encountered in the prior art.

With the invention thus explained, it is apparent that various modifications and variations can be made without departing from the spirit of the present invention. It is therefore intended that the invention be limited only as recited in the appended claims.

I claim:

1. An electrical connector adapted for mounting on a printed circuit board, comprising:

an insulator housing having a longitudinally extending base portion with two opposite ends, a mating portion disposed between said opposite ends and projecting from said base portion in a transverse direction relative to said base portion, and two retaining extensions extending respectively from said opposite ends of said base portion, each of said retaining extensions including a lower part that is formed with a retaining slot extending in a lateral direction relative to said base portion and that has a top retaining wall disposed above and defining a top end of said retaining slot, a bottom retaining wall disposed below and defining a bottom end of said retaining slot, and a bottom opening formed in said bottom retaining wall and communicated spatially with said retaining slot, said mating portion having a plurality of terminal passages formed therein;

a pair of board locking members, each having an inserting portion disposed in a respective one of said retaining slots, and a locking peg projecting downwardly from said inserting portion through a respective one of said bottom openings, said inserting portions of said board locking members respectively abutting against said top retaining walls within said retaining slots when said locking pegs are pushed upwardly; and a plurality of terminals fittingly and respectively mounted in said terminal passages in said mating portion;

each of said retaining extensions further including an upper part extending upwardly from one end of said lower part, each of said retaining slots having one end opening at said end of the respective one of said lower parts, and each of said board locking members further includes a stem portion extending upwardly from one end of said inserting portion and attached to said upper part of the respective one of said retaining extensions;

said upper part of each of said retaining extensions having a front face co-planar with a front face of said base portion, said stem portion of each of said board locking members being attached to said front face of the respective one of said upper parts, said mating portion projecting from said front face of said base portion;

said upper part of each of said retaining extensions having a top end formed with a mounting slot that extends in the transverse direction, each of said board locking members further including a hooking tongue projecting from said stem portion into said mounting slot in said top end of the respective one of said upper parts.

2. The electrical connector of claim 1, wherein each of said bottom openings extends in the transverse direction from said end of the respective one of said lower parts so as to permit said board locking members to move respectively along said retaining slots.

3. The electrical connector of claim 1, wherein said front face of each of said upper parts is formed with a mounting recess, said stem portion of each of said board locking members being mounted in said mounting recess in said front face of the respective one of said upper parts and being flush with said front face of said base portion.

4. The electrical connector of claim 1, wherein said locking peg has a slit and a pair of opposite locking legs spaced apart by said slit and projecting downwardly from said inserting portion through said bottom opening in the respective one of said lower parts, each of said locking legs having an anchoring bottom end.

5. The electrical connector of claim 1, wherein each of said board locking members is formed integrally as a stamped and bent metal plate.

6. The electrical connector of claim 5, further comprising a conductive shield mounted on and disposed around said mating portion, said conductive shield having a base plate with two opposite end portions that cooperate with said upper parts of said retaining extensions to sandwich said stem portions of said board locking members, respectively.

* * * * *